US009989263B2

(12) United States Patent
Olesen

(10) Patent No.: US 9,989,263 B2
(45) Date of Patent: Jun. 5, 2018

(54) RADIATOR

(71) Applicant: RIBE JERN HOLDING A/S, Ribe (DK)

(72) Inventor: Michael Boel Olesen, Brørup (DK)

(73) Assignee: RIBE JERN HOLDING A/S, Ribe (DK)

( * ) Notice: Subject to any disclaimer, the term of this patent is extended or adjusted under 35 U.S.C. 154(b) by 175 days.

(21) Appl. No.: 14/861,237

(22) Filed: Sep. 22, 2015

(65) Prior Publication Data

US 2017/0082383 A1 Mar. 23, 2017

(51) Int. Cl.
*F28D 1/00* (2006.01)
*F24D 3/10* (2006.01)

(52) U.S. Cl.
CPC ..... *F24D 3/1075* (2013.01)

(58) Field of Classification Search
CPC .... F24D 3/1075; F28D 1/0443; F28D 1/0417; F28F 9/262
USPC ..... 165/49, 50
See application file for complete search history.

(56) References Cited

FOREIGN PATENT DOCUMENTS

| | | | | |
|---|---|---|---|---|
| DE | 202013104887 U1 * | 11/2013 | ..... | F24D 3/14 |
| EP | 0448473 A1 * | 9/1991 | ..... | F24D 19/02 |
| EP | 1243870 A2 * | 9/2002 | ..... | F24D 19/06 |

* cited by examiner

*Primary Examiner* — Devon Russell
(74) *Attorney, Agent, or Firm* — Ziegler IP Law Group, LLC

(57) ABSTRACT

The invention relates to a radiator (1, 11) with a heating water duct system, within which heating water is able to be transported from a heating water intake (3, 15) to a heating water outlet (4, 16), wherein the heating water duct system comprises:

Figure 1:
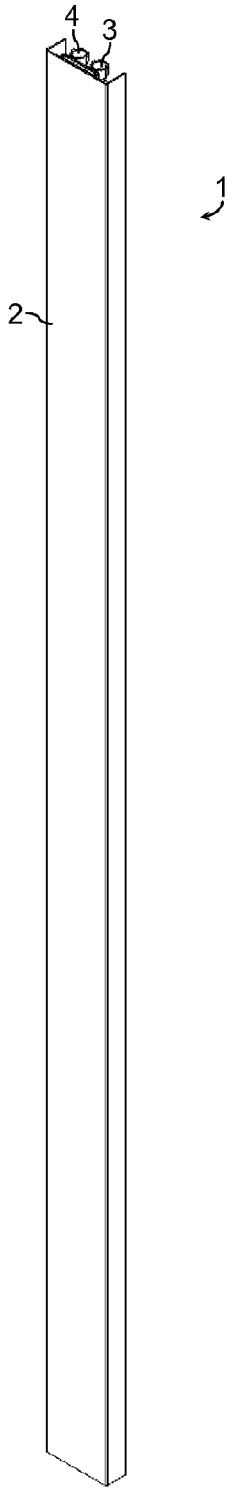

heating segments (5,6,12,13,14) with respectively an internal cavity for receiving heating water, which in a ready-to-operate state of the radiator (1, 11) are arranged over one another in gravitation direction, and which respectively have an inlet opening for the supply of heating water and an outlet opening for the removal of heating water;

a connecting pipe (7, 17), which connects the outlet opening of a first heating segment (5, 12) with the inlet opening of a second heating segment (6, 13);

wherein the heating water inlet (3, 15) is connected to the inlet opening of the first heating segment (5, 12), and wherein the second heating segment (6, 13) in the ready-to-operate state of the radiator (1, 11), viewed in gravitation direction, is arranged above the first heating segment (5, 12).

8 Claims, 3 Drawing Sheets

RADIATOR

The invention relates to a radiator.

Radiators serve generally for heating parts of buildings or respectively rooms and typically have a heating water duct system, within which heating water can circulate. The required heating water is made available through a building-side heating pipe system. More precisely, the heating water enters into the radiator through a heating water intake, heats the radiator and subsequently exits from the radiator again through a heating water outlet.

As the density of the heating water typically decreases with increasing temperature, conventional radiators, viewed in gravitation direction, are warmer at the top than at the bottom. However, this is sometimes undesirable for structural-physical reasons and/or for reasons of wellbeing (in particular if the radiator is situated beneath a window, but also if the radiator is situated in the wall or laterally in the frame, e.g. in the frame of a window recess).

The invention is based on the problem of presenting a radiator which enables a more intensive heating of portions situated further at the bottom, viewed in gravitation direction, than portions situated further at the top.

This problem is solved by a radiator having the features of claim 1. Advantageous embodiments are described in the subclaims.

The radiator according to the invention has a heating water duct system, within which heating water is able to be transported from a heating water intake to a heating water outlet. The heating water duct system of the radiator comprises heating segments with respectively an internal cavity for receiving heating water, which are arranged over one another, viewed in gravitation direction, in a ready-to-operate state of the radiator, and which have respectively an inlet opening for the supply of heating water and an outlet opening for the removal of heating water. In addition, the heating water duct system has a connecting pipe, which connects the outlet opening of a first heating segment with the inlet opening of a second heating segment. The heating water intake is connected to the inlet opening of the first heating segment. In the ready-to-operate state of the radiator, the second heating segment is arranged above the first heating segment, viewed in gravitation direction.

"Ready-to-operate state" of the radiator is understood here to mean the state in which the radiator is connected to the on-site heating pipe system, i.e. the heating water intake is connected with a feed line of the heating pipe system and the heating water outlet is connected with a return of the heating pipe system.

The terms "top", "above", "upper" etc. and "bottom", "below", "upper" etc.—in so far as not mentioned otherwise—are to be regarded in reference to the gravitation direction.

According to the invention, heating water thereby enters into the radiator through the heating water intake. As the heating water intake is connected to the inlet opening of the first heating segment, firstly the first heating segment is heated and the heating water is only subsequently fed through the connecting pipe to the second heating element, which is situated above the first heating segment, viewed in gravitation direction. In this way, it is therefore possible to heat the first heating segment to a higher temperature than the second heating segment.

In an advantageous embodiment, the inlet opening of the first heating segment is constructed at an upper end of the first heating segment, viewed in gravitation direction. The supply of the heating water therefore takes place in an upper region of the first heating segment.

In a further advantageous embodiment, the outlet opening of the first heating segment is constructed at a lower end of the first heating segment, viewed in gravitation direction.

In an advantageous embodiment, the outlet opening of the heating segment arranged furthest at the top, viewed in gravitation direction, is connected to the heating water outlet. In this way, the uppermost heating segment has the lowest temperature of all the heating segments.

In a further advantageous embodiment, the first heating element is the lowest heating element, viewed in gravitation direction. Thereby, the lowermost heating segment has the highest temperature of all the heating segments.

In an advantageous embodiment, the heating elements have respectively the shape of a flat cuboid. In this way, a particularly good radiation of heat is possible.

In an advantageous embodiment, the radiator has in addition a cover which extends over all the heating elements. Thereby, a visually uniform impression is produced.

Radiators with precisely two and precisely three heating elements have proved to be particularly advantageous. Radiators with two heating elements are configured in a structurally simple manner. Radiators with three heating elements permit a more exact setting of the temperature profile.

When the radiator has precisely two heating elements, then the inlet opening of the second heating element is constructed in a preferred manner at a lower end, viewed in gravitation direction, of the second heating segment and the outlet opening of the second heating element is constructed at an upper end, viewed in gravitation direction, of the second heating segment and connected to the heating water outlet.

When the radiator has precisely three heating elements, then the inlet opening of the second heating element is constructed in a preferred manner at an upper end, viewed in gravitation direction, of the second heating segment, the outlet opening of the second heating element is constructed at a lower end, viewed in gravitation direction, of the second heating segment, the inlet opening of the third heating element is constructed at a lower end, viewed in gravitation direction, of the third heating segment, the outlet opening of the third heating element is constructed at an upper end of the third heating segment, viewed in gravitation direction, and connected to the heating water outlet, and a further connecting pipe connects the outlet opening of the second heating segment with the inlet opening of the third heating segment.

Figure 2:
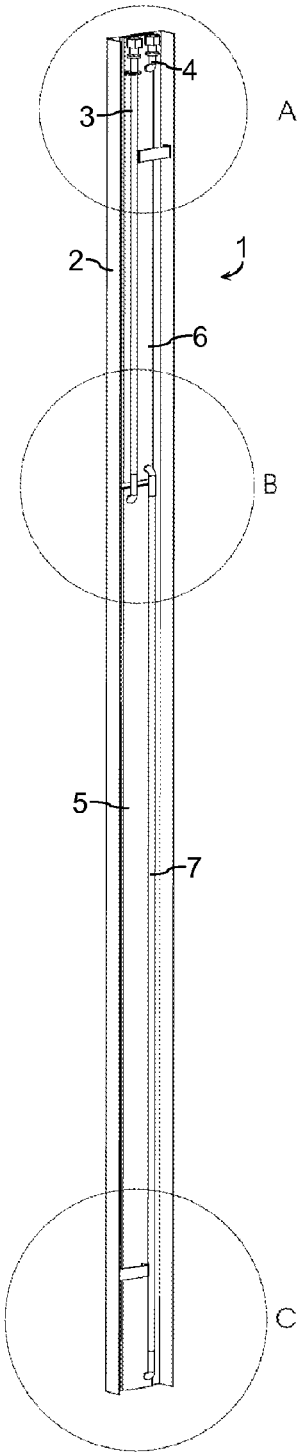
Figure 3:
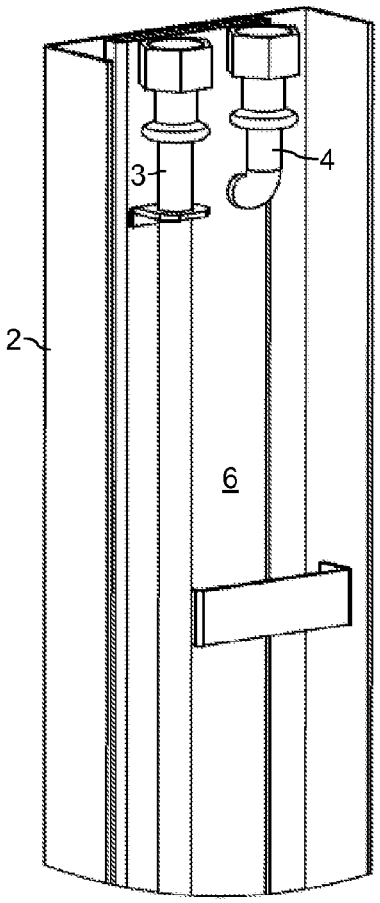
Figure 4:
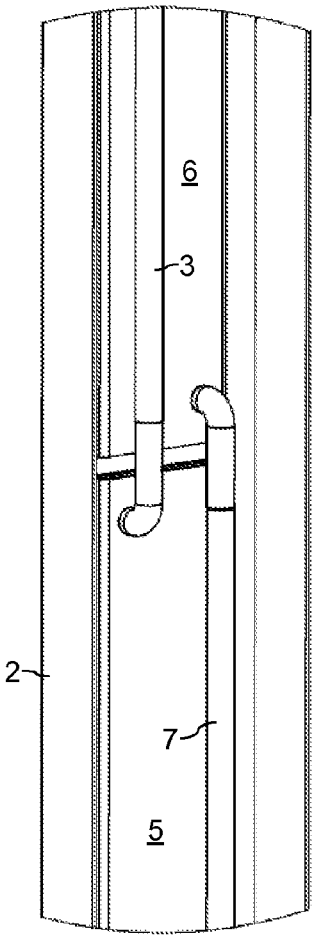
Figure 5:
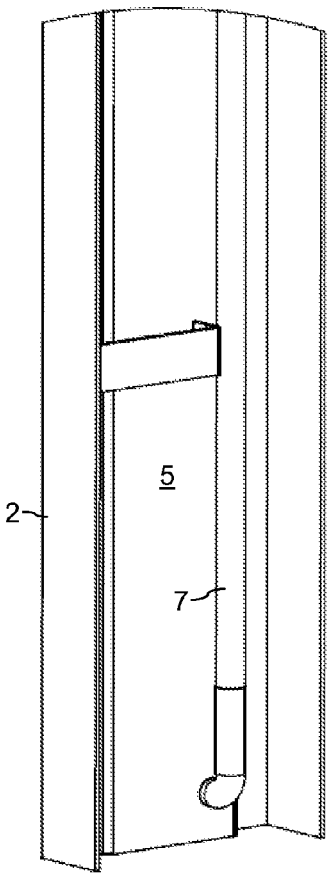

The invention is further explained with the aid of example embodiments in the figures of the drawings. There are shown:

FIG. 1 a perspective front view of a first embodiment of a radiator;

FIG. 2 a perspective rear view of the radiator of FIG. 1;

FIG. 3 an enlarged detail view of the region A of FIG. 2;

FIG. 4 an enlarged detail view of the region B of FIG. 2;

FIG. 5 an enlarged detail view of the region C of FIG. 2; and

Figure 6:
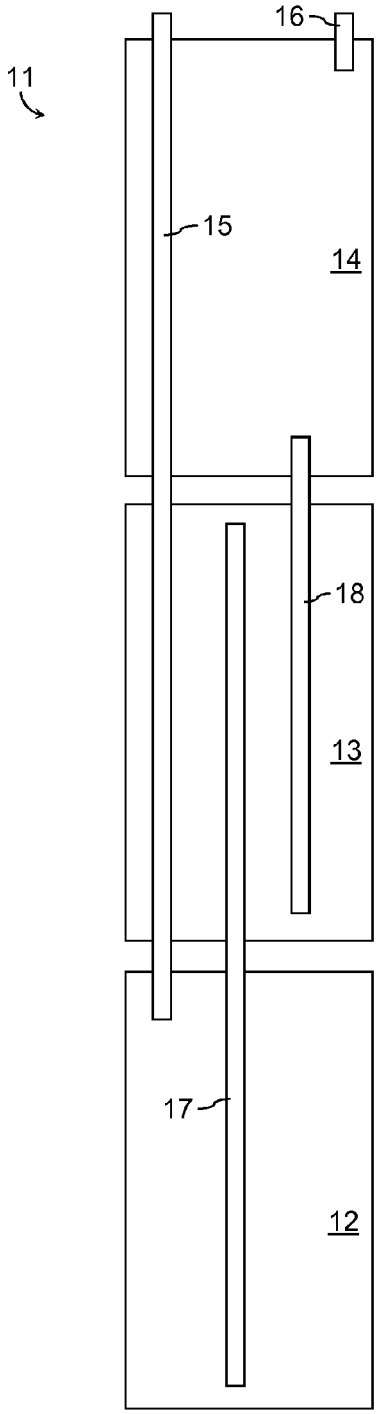

FIG. 6 a diagrammatic rear view of a second embodiment of a radiator.

FIG. 1 to FIG. 5 show a radiator 1. The front and the lateral faces of the radiator 1 are covered by a cover 2. Heating water can flow through a heating water intake (heating water inlet) 3 into a heating water duct system of the radiator 1 and can flow off again through a heating water outlet 4. Within the heating water duct system, heating water is therefore able to be transported from the heating water intake 3 to the heating water outlet 4.

Two heating segments 5 and 6 are concealed by the cover 2. Each of the heating segments 5, 6 has the shape of a flat cuboid and has an internal cavity for receiving heating water. Each heating segment 5, 6 has an inlet opening for the supply of heating water and an outlet opening for the removal of heating water. In the ready-to-operate state of the radiator 1 and in the figures of the drawings, the heating segments 5, 6 are arranged over one another.

The heating segment 5 is arranged beneath the heating segment 6. The heating element 5 therefore constitutes a "first heating element", whilst the heating segment 6 constitutes a "second heating element".

The inlet opening of the first heating segment 5 is constructed at the upper end of the first heating segment 5 and is connected with the heating water intake 3. The outlet opening of the first heating segment 5 is constructed at the lower end of the first heating segment 5 and is connected via a connecting pipe 7 with the inlet opening of the second heating element 6. The inlet opening of the second heating element 6 is constructed at the lower end of the second heating element 6. The outlet opening of the second heating element 6, in turn, is constructed at the upper end of the second heating element 6 and is connected with the heating water outlet 4.

Heating water with a high temperature, which is supplied via the heating water intake 3, therefore flows firstly through the inlet opening of the first heating segment 5 into the internal cavity of the first heating segment 5 and heats the heating segment 5 accordingly. Subsequently, the heating water flows via the outlet opening of the first heating element 5 into the connecting pipe 7 and from the connecting pipe 7 via the inlet opening of the second heating segment 6 into the internal cavity of the second heating segment 6 and heats the heating segment 6 accordingly. During the passage through the radiator 1, the temperature of the heating water gradually reduces through heat transmission. Finally, the (now correspondingly cooled) heating water flows off again via the outlet opening of the second heating segment 6 and the heating water outlet 4.

The first heating segment 5 is situated, viewed in gravitation direction, further below than the second heating segment 6 and is heated more than the second heating segment 6 situated further above. The radiator 1 therefore has a lower portion (first heating segment 5), which is warmer than an upper portion (second heating segment 6).

FIG. 6 shows a diagrammatic rear view of a second embodiment. The radiator 11 illustrated diagrammatically there has a total of three heating segments 12, 13 and 14.

Each of the heating segments 12, 13, 14 has the shape of a flat cuboid and has an internal cavity for receiving heating water. Each heating segment 12, 13, 14 has an inlet opening for the supply of heating water and an outlet opening for the removal of heating water. In the ready-to-operate state of the radiator 11 and in the figures of the drawings, the heating segments 12, 13, 14 are arranged over one another. The heating segment 12 here is the lowermost heating segment. The heating segment 13 adjoins the heating segment 12. The heating segment 14 is the uppermost heating segment.

Heating water can flow in through a heating water intake 15 and flow off again through a heating water outlet 16. The inlet opening of the heating segment 12 is constructed at the upper end of the heating segment 12 and is connected with the heating water intake 15. The outlet opening of the heating segment 12 is constructed at the lower end of the heating segment 12 and is connected with the inlet opening of the heating element 13 via a connecting pipe 17. The inlet opening of the heating element 13 is constructed at the upper end of the heating element 13. The outlet opening of the heating element 13 is constructed, in turn, at the lower end of the heating element 13 and is connected with the inlet opening of the heating element 14 via a further connecting pipe 18. The inlet opening of the heating element 14 is constructed at the lower end of the heating element 14. The outlet opening of the heating element 14, in turn, is constructed at the upper end of the heating element 14 and is connected with the heating water outlet 16. The heating element 14 therefore constitutes a "first heating element", the heating segment 13 a "second heating element" and the heating element 14 a "third heating element".

Heating water with high temperature, which is supplied via the heating water intake 15, therefore flows firstly through the inlet opening of the first heating segment 12 into the internal cavity of the first heating segment 12 and heats the heating segment 12 accordingly. The heating water subsequently flows via the outlet opening of the first heating element 12 into the connecting pipe 17 and from the connecting pipe 17 via the inlet opening of the second heating segment 13 into the internal cavity of the second heating segment 13, and heats the heating segment 13 accordingly. Thereupon, the heating water flows via the outlet opening of the second heating element 13 into the further connecting pipe 18 and from the connecting pipe 18 via the inlet opening of the third heating segment 14 into the internal cavity of the third heating segment 14 and heats the third heating segment 14 accordingly. During the passage through the radiator 11, the temperature of the heating water gradually reduces through heat transmission. Finally, the (now correspondingly cooled) heating water flows off again via the outlet opening of the third heating segment 14 and the heating water outlet 16.

The first heating segment 12 is situated, viewed in gravitation direction, further below than the second heating segment 13 and is heated more than the second heating segment 13 which is situated further above. The second heating segment 13, in turn, is situated, viewed in gravitation direction, further below than the third heating segment 14 and is heated more than the third heating segment 14.

LIST OF REFERENCE NUMBERS

1, 11 radiator
2 cover
3, 15 heating water intake
4, 16 heating water outlet
5,6,12,13,14 heating segment
7, 17, 18 connecting pipe

The invention claimed is:

1. A radiator with a heating water duct system, within which heating water is able to be transported from a heating water intake to a heating water outlet, wherein the heating water duct system comprises:

two heating segments defining a first heating segment and a second heating segment, respectively, each heating segment having an internal cavity for receiving heating water, and an inlet opening for the supply of heating water and an outlet opening for the removal of heating water;

a connecting pipe, which connects an outlet opening of said first heating segment with an inlet opening of said second heating segment;

wherein the heating water intake is connected to the inlet opening of the first heating segment, wherein the second heating segment in a ready-to-operate state of the radiator, viewed in a gravitation direction of the heating water, is arranged above the first heating segment;

wherein the inlet opening of the first heating segment is constructed at an upper end of the first heating segment viewed in the gravitation direction;

the outlet opening of the first heating segment is constructed at a lower end of the first heating segment, viewed in the gravitation direction;

the inlet opening of the second heating element is constructed at a lower end of the second heating segment, viewed in the gravitation direction; and the outlet opening of the second heating element is constructed at an upper end of the second heating segment, viewed in the gravitation direction and is connected to the heating water outlet.

2. The radiator according to claim 1, wherein the heating elements have a shape of a flat cuboid.

3. The radiator according to claim 1, a cover defining a front of said radiator.

4. The radiator according to claim 3, said first heating segment having a rear face oriented away from said cover, at least a portion of said connecting pipe extending along said rear face.

5. A radiator with a heating water duct system, within which heating water is able to be transported from a heating water intake to a heating water outlet, wherein the heating water duct system comprises:

three heating segments defining a first heating segment, a second heating segment and a third heating segment, respectively, each heating segment having an internal cavity for receiving heating water, and an inlet opening for the supply of heating water and an outlet opening for the removal of heating water;

wherein an inlet opening of the first heating segment is constructed at an upper end of the first heating segment, viewed in a gravitation direction of the heating water;

a connecting pipe, which connects an outlet opening of said first heating segment with an inlet opening of said second heating segment;

wherein the heating water intake is connected to the inlet opening of the first heating segment, and wherein the second heating segment in a ready-to-operate state of the radiator, viewed in the gravitation direction is arranged directly above the first heating segment;

wherein the third heating segment in the ready-to-operate state of the radiator viewed in the gravitation direction is arranged directly above the second heating segment;

wherein:

the inlet opening of the second heating segment is constructed at an upper end of the second heating segment, viewed in the gravitation direction;

the outlet opening of the second heating segment is constructed at a lower end of the second heating segment, viewed in the gravitation direction;

the inlet opening of the third heating segment is constructed at a lower end of the third heating segment, viewed in the gravitation direction;

the outlet opening of the third heating segment is constructed at an upper end of the third heating segment, viewed in the gravitation direction and is connected to the heating water outlet;

a further connecting pipe connects the outlet opening of the second heating segment with the inlet opening of the third heating segment.

6. The radiator according to claim 5, wherein the heating segments have a shape of a flat cuboid.

7. The radiator according to claim 6, a cover defining a front of said radiator.

8. The radiator according to claim 7, said first, second and third heating segment having a rear face oriented away from said cover, at least a portion of said connecting pipes extending along said rear face.

* * * * *